United States Patent [19]

Bähnsch et al.

[11] 4,026,768

[45] May 31, 1977

[54] DOOR EXTRACTING AND CLEANING MACHINE FOR COKE OVENS

[75] Inventors: Hans Bähnsch, Breitscheid; Hans-Jürgen Kwasnik, Wanne-Eickel, both of Germany

[73] Assignee: Dr. C. Otto & Comp. G.m.b.H., Bochum, Germany

[22] Filed: June 2, 1975

[21] Appl. No.: 583,034

[30] Foreign Application Priority Data

May 31, 1974 Germany ..... 2426428

[52] U.S. Cl. ..... 202/241; 202/248; 202/262

[51] Int. Cl.[2] ..... C10B 25/14; C10B 43/04; C10B 33/14

[58] Field of Search ..... 202/262, 241, 248

[56] References Cited

UNITED STATES PATENTS

| | | | |
|---|---|---|---|
| 3,463,316 | 4/1969 | Lorrek | 202/262 X |
| 3,577,321 | 5/1971 | Schaten | 202/262 X |
| 3,817,840 | 6/1974 | Stender | 202/262 X |

*Primary Examiner*—Morris O. Wolk
*Assistant Examiner*—Arnold Turk
*Attorney, Agent, or Firm*—Brown, Murray, Flick & Peckham

[57] ABSTRACT

A carriage movable along the coke side of a coke oven battery and carrying a coke guide, a door extractor, a frame cleaner and a door cleaner. These elements can be manipulated on the carriage so as to effect door extraction, coke pushing, door cleaning and frame cleaning in a minimum amount of time and without the necessity for moving the carriage itself along the coke oven battery while servicing any one coke oven chamber.

1 Claim, 8 Drawing Figures

DOOR EXTRACTING AND CLEANING MACHINE FOR COKE OVENS

BACKGROUND OF THE INVENTION

As is known, regenerative coke oven installations have a pusher side and a coke side, the coke being pushed from an oven chamber from the pusher side and through a coke guide on the coke side into a quenching car. The coke guide is carried on a car or carriage along with a door extractor, a frame cleaner and a door cleaner. The purpose of the devices carried on the carriage is to: (1) lift of the unlocked oven door when an oven is to be emptied and to clear the oven line, (2) move the coke guide to the oven opening such that the coke can be pushed through the coke guide and into a quenching car, (3) move the coke guide to one side and traverse the frame cleaner to the oven opening to enable the cleaner to perform a cleaning operation on the frame and in the meantime have the door cleaner clean the door, and (4) finally replace and lock the door by means of the door extractor. These various devices, namely the door extractor, the frame cleaner and the coke guide must be accurately aligned with the longitudinal axis of a coke oven chamber for the various operations. Repeated traversing of the carriage on which these elements are carried with respect to the coke oven chamber axis is, therefore, necessary if the apparatus is fixed on the carriage. In the past, door extracting and cleaning apparatus have been mounted on a carriage in such a way that the aforementioned removing and cleaning operations can be performed without traversing the carriage itself along the coke oven battery. Prior art devices of this type, however, are relatively cumbersome and not altogether satisfactory.

SUMMARY OF THE INVENTION

In accordance with the present invention, a new and improved door extracting and cleaning machine for coke ovens is provided wherein the carriage or car on which the door extracting device, the coke guide, and the cleaners are carried remains stationary during the extraction, pushing and cleaning operations. This is achieved by mounting the door extractor, the coke guide and the frame cleaner on a frame which can longitudinally traverse the carriage on which they are mounted so as to successively align the extractor, the coke guide and the frame cleaner with a coke oven chamber. At the same time, the door extractor mounted on the traversing frame is pivotal through 90° so that it can remove the door and pivot it through 90° into alignment with a stationary door cleaner mounted on the carriage.

In operation, the traversing frame moves the door extractor into alignment with a coke oven chamber, and the door is extracted and pivoted through 90°. Thereafter, as the frame is moved to successively align the coke guide and frame cleaner with the same coke oven chamber, the door is moved into engagement with a door cleaner and is cleaned. Finally, by traversing the frame backwardly and rotating the door extractor through 90° in a sense opposite to the first rotation, the door can again be aligned with the coke oven chamber and replaced, completing the entire removal, pushing and cleaning operations without traversing the carriage on which the various elements are mounted.

The above and other object and features of the invention will come apparent from the following detailed description taken in connection with the accompanying drawings which form a part of this specification, and in which:

FIGS. 1*a*–1*d* diagrammatically illustrate different positions of the door extractor, coke guide and cleaning elements on a stationary carriage in order to carry out the invention;

With reference now to the drawings, and particularly to FIGS. 1*a*–1*d*:

W is a carriage traversable on the coke side of a coke oven battery and carrying a coke guide and the door extraction and cleaning apparatus, K is a coke oven chamber from which coke is to be discharged, A is a door extractor carried on carriage W, T is the oven door, F is a guide for the coke which is to be pushed out of the chamber K, R is a device carried on carriage W for cleaning the door frame, and D is a device carried on the carriage W for cleaning the door T.

Figure 1A:
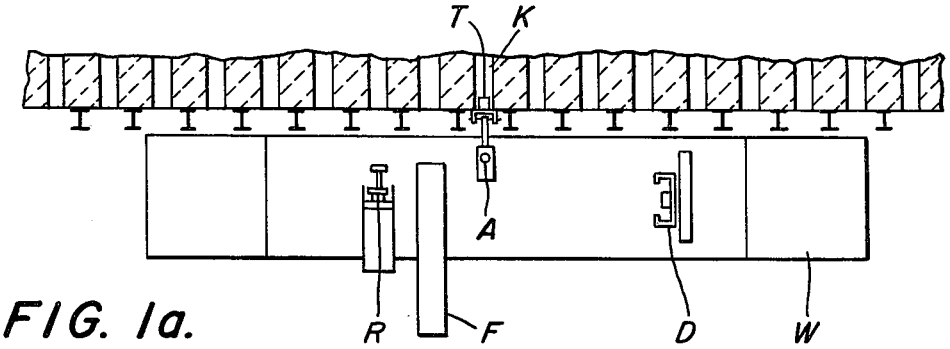

It will be noted that the carriage W is in the same position in all illustrations, FIGS. 1*a*–1*d*. The door cleaner D is stationary on the carriage W; however, as will hereinafter be explained, elements R, F and A are mounted on a movable frame which can traverse the longitudinal axis of the carriage W. In FIG. 1*a*, the door extractor A is aligned with the oven chamber K such that it can lift the door T from that oven chamber. After the extractor A is aligned with the oven chamber K, it engages the door T and is then moved downwardly as viewed in FIG. 1*a* to remove the door T. As the extractor A is moved downwardly, it is rotated clockwise through 90°. Thereafter, a frame on which elements R, F and A are carried is traversed to the right as shown in the drawings until the coke guide F is aligned with the coke oven chamber K. At this point, the coke in chamber K is pushed out of the chamber by a pushing device on the opposite side of the coke oven battery. The coke guide F is then retracted and elements R, K and A are moved further to the right as shown in the drawings (FIG. 1*c*) such that the frame cleaner R is now aligned with the coke oven chamber K; while the door T is in a position to be cleaned by the stationary door cleaner D. At this point, the seal around the door T is cleaned by the cleaning device D and the forward edge or frame of the chamber K is cleaned by the frame cleaner R. The elements are now in the position shown in FIG. 1*c*.

Figure 1B:
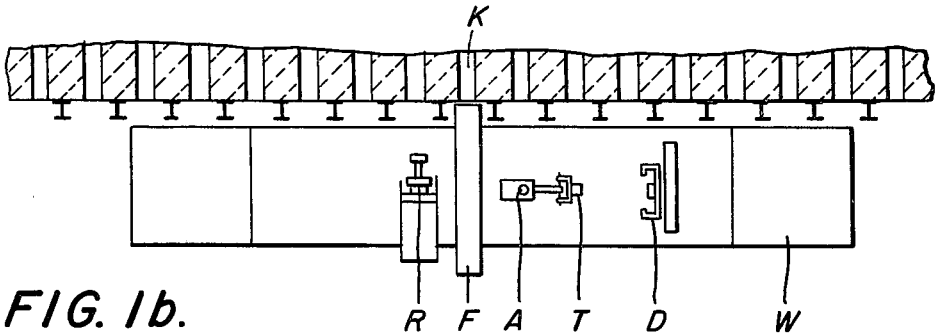
Figure 1C:
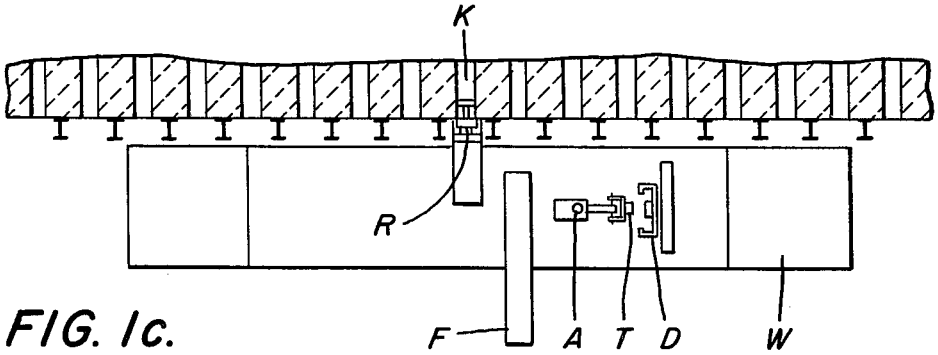
Figure 1D:
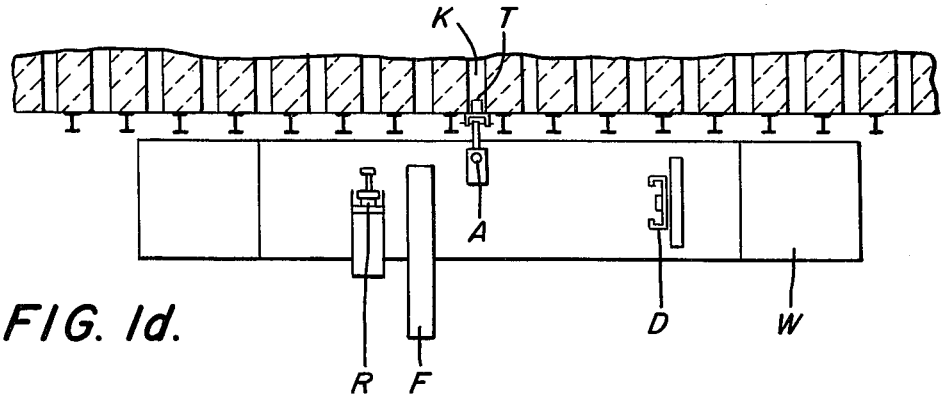

When the frame cleaning and door cleaning operations are completed, the frame cleaner R is retracted; and door T is pivoted through 90° in a counterclockwise direction while the frame on which the elements R, F and A are mounted traverses to the left so that the extractor A is now aligned with the coke oven chamber K as shown in FIG. 1*d*. At this point, the door T is replaced and the extractor A is retracted such that the carriage W can be moved to another coke oven chamber where the foregoing operations are repeated.

Figure 2:
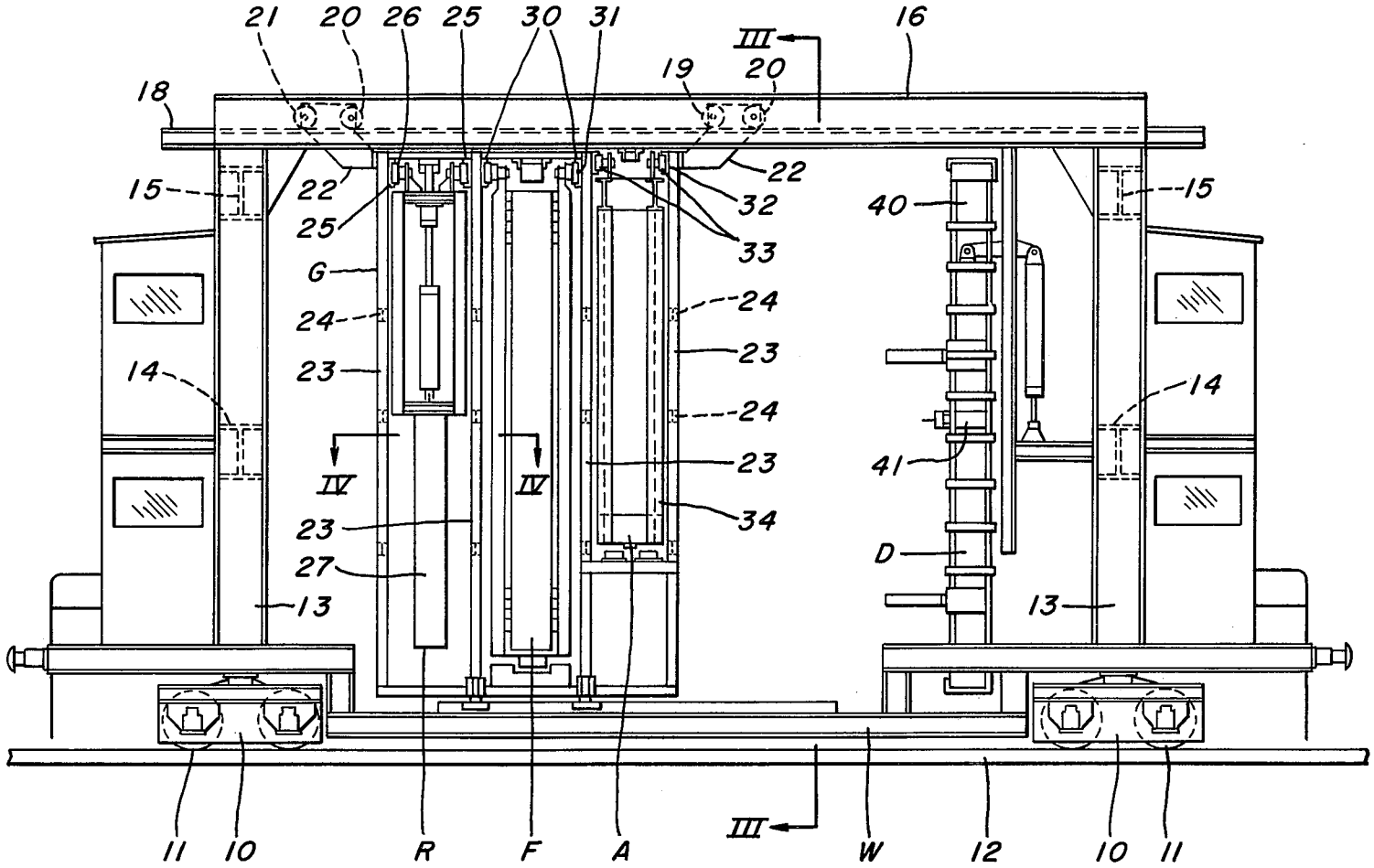
FIG. 2 is a plan view of the carriage on which the various extracting and cleaning devices are mounted, looking toward the coke oven battery.
Figure 3:
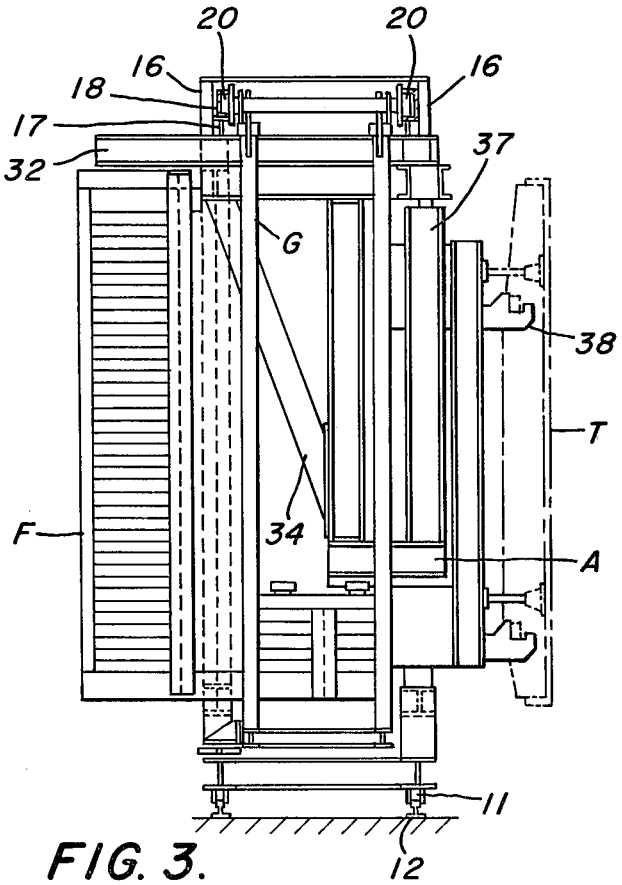
FIG. 3 is a cross-sectional view taken substantially along line III—III of FIG. 2.

The details of the carriage and the various elements carried thereon are shown in FIGS. 2–5. In FIG. 2, two trucks 10 support the carriage or car W and carry wheels 11 which ride on rails 12 (FIG. 3) extending along the coke oven battery. Projecting upwardly from the base or floor of the carriage W are columns 13 which are interconnected by means of middle transverse struts 14 and top transverse struts 15. The upper ends of the columns 13 are interconnected by means of longitudinal beams 16. As shown in FIG. 3, brackets 17 support rails 18 which are situated on the inside of both longitudinal beams 16. A frame G carrying the door extractor A, the coke guide F and the frame cleaner R can traverse the tracks 18 by means of wheels 20. The wheels 20 are mounted on trucks 19 and 21, substantially as shown. Longitudinal girders 22 connect the trucks 19 and 21 to the frame G. It will be appreciated, therefore, that the frame G which carries the three elements A, F and K can traverse the longitudinal beams 16 of the carriage W along the tracks 18. The frame G is provided with a stiffening network which comprises vertical longitudinal bars 23 and cross-struts 24 which connect to the longitudinal bars 23 at the sides thereof.

Inwardly facing channels 25 on frame G form tracks for the wheels 26 of the door frame cleaner R. As may be seen by reference to FIG. 4, the frame cleaner R is provided with a guard plate 27 which extends into the coke oven chamber K during a cleaning operation and is provided with scrapers 28 for cleaning the inside of the door frame and with scrapers 29 for cleaning the sealing surface around the door frame. The manner in which the scrapers 28 and 29 are traversed upwardly and downwardly along the door frame is conventional and need not be described herein in detail.

The coke guide F is supported on wheels 31 (FIG. 2) which can traverse the tracks or channels 30 on frame G. The two positions of the coke guide (i.e., for coke pushing and for traversing) are shown in FIGS. 1*a* and 1*b*. The door extractor A is also provided with wheels 33 (FIG. 2) which extend along tracks or channel irons 32 on frame G. The wheels 33 support the frame 34 of the extractor.

Figure 5:
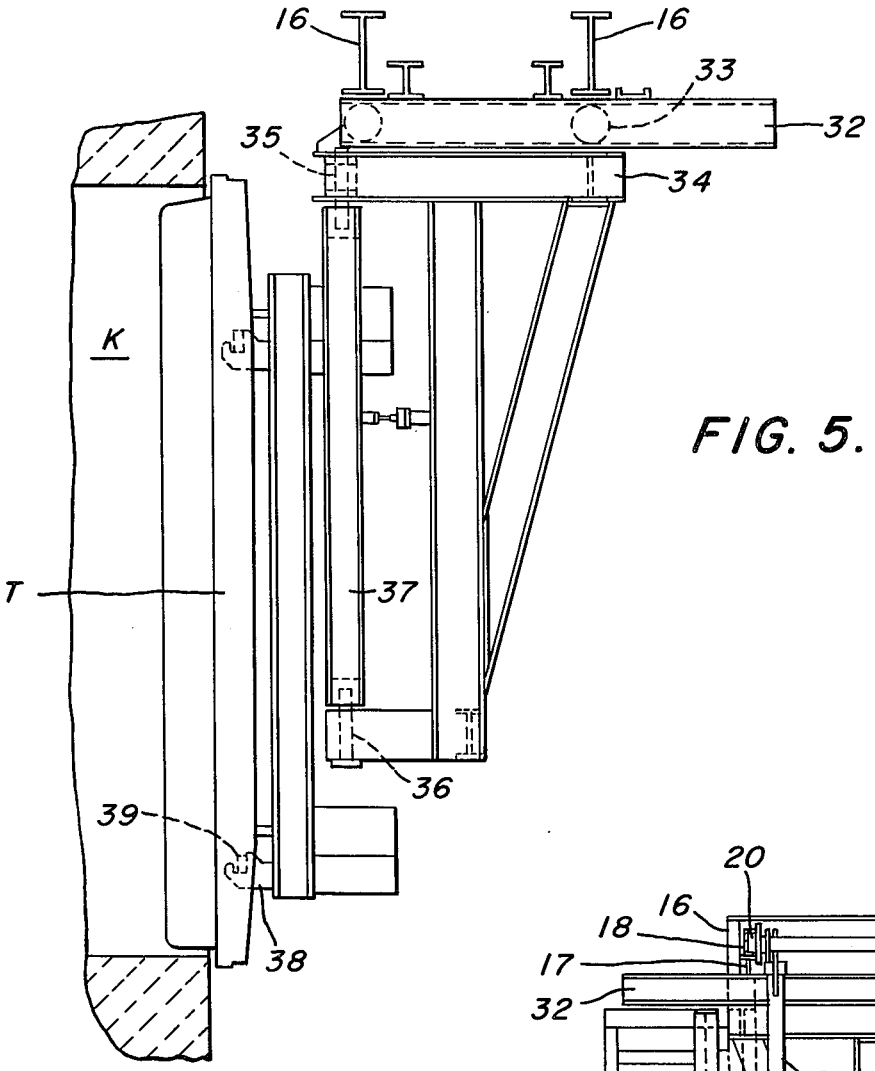
FIG. 5 is a side plan view of the door extractor of the apparatus of FIG. 2.

As may be seen by reference to FIG. 5, the door extractor A comprises the frame or supporting structure 34 supported on channels 32 by the wheels 33. At the forward end of the frame 34 is a longitudinal beam 37 supported on the frame 34 by means of an upper trunnion 35 and a lower trunnion 36 such that the element or beam 37 may be rotated through 90°. The element 37 carries hooks 38 which are adapted to move under latches 39 on a door T to slightly lift the door and remove it from the oven chamber K.

In the operation of the device, the carriage W is moved into a position wherein the door extractor A is aligned with a coke oven chamber K. At this point, the door extractor shown in FIG. 5 is caused to move to the left on tracks 32 such that the hooks 38 engage the latches 39. At this point, suitable means, not described herein in detail, slightly lift the hooks 38 and the door, whereupon the frame 34 carrying element 37 is caused to move away from the oven chamber, thereby removing the door T. At the same time, the element 37 is caused to pivot about trunnions 35 and 36 and into the positions shown in FIG. 1*b*. The various actuating devices for performing the foregoing operations are conventional in the art and need not be described herein in detail.

Thereafter, and assuming that the door T has been removed and rotated into the position shown in FIG. 1*b*, the frame G is moved to the left as viewed in FIG. 2 until the coke guide F is aligned with the chamber K. At this point, a pusher on the opposite side of the coke oven battery pushes coke through the guide F and into a quenching car, not shown. After this operation is completed, the frame G is moved further to the right as viewed in FIG. 2. At this point, the door T, now carried on the hooks 38 of FIG. 5, is moved into engagement with the door cleaning device D. The door cleaning device comprises a frame 40 (FIG. 2) on which cleaning elements 41 can move to clean the door prior to its being reinserted into the opening of the oven chamber K.

Figure 4:
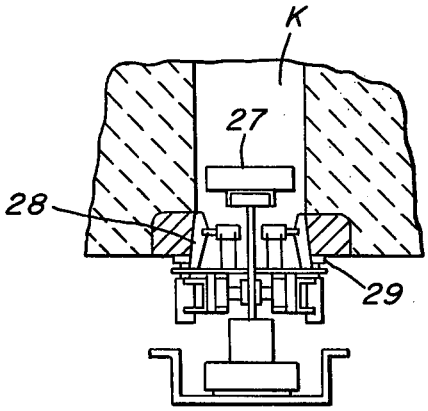
FIG. 4 is a cross-sectional view taken substantially along line IV—IV of FIG. 2 showing the details of the frame cleaner.

At the same time that the door T is moved into engagement with the cleaning device D as the frame G moves to the right, the frame cleaner R is moved into alignment with the oven chamber K and is caused to move forwardly toward the mouth of the oven chamber until it assumes the position shown in FIG. 4. At this point, the frame is cleaned by the scrapers 28 and 29 of FIG. 4, and the door cleaner R is moved backwardly on the tracks 25. Then, the entire frame G is moved to the left as viewed in FIG. 2 while the door extractor A is rotated about the trunnions 35 and 36 until the extractor A is aligned with the oven chamber K as viewed in FIG. 1*d*. At this point, the frame 34 of the extractor is moved forwardly on tracks 32 until the oven door T is again replaced and the operation is completed.

It can thus be seen that the present invention provides a means for conveniently and efficiently performing the operations of door extraction, pushing, door cleaning and frame cleaning without moving the carriage W along the coke oven battery and with a minimum number of manipulative steps. Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A carriage adapted to traverse along a coke oven battery parallel to and on the coke side thereof, said carriage having a frame movable thereon parallel to the said coke side of said oven battery and said frame carrying a coke oven door extractor, a coke guide and a door jamb cleaner, said carriage also having means including parallel rails for movement of the frame along the carriage to align with a coke oven chamber in succession the door extractor, the coke guide and the door jamb cleaner, means pivotally mounting the door extractor on said frame whereby it is rotatable from a position where it is aligned with a coke oven chamber to a position where it is perpendicular thereto, and a door frame cleaner stationarily mounted on said carriage and adapted to engage a door to be cleaned after said door extractor is perpendicular to said oven chamber and said frame has been traversed on said carriage to a position where the door engages said door frame cleaner, said coke guide being mounted on said frame intermediate said door extractor and said door jamb cleaner, the door extractor being on the side of said frame facing said door frame cleaner whereby pivotal movement of the extractor with a door thereon will move the door into alignment with said door frame cleaner, the door engaging the door frame cleaner when said door jamb cleaner is in alignment with said coke oven chamber.

* * * * *